US011130172B2

(12) United States Patent
Andreatta et al.

(10) Patent No.: US 11,130,172 B2
(45) Date of Patent: Sep. 28, 2021

(54) CONTINUOUS CASTING METHOD AND CORRESPONDING APPARATUS

(71) Applicant: DANIELI & C. OFFICINE MECCANICHE S.P.A., Buttrio (IT)

(72) Inventors: Daniele Andreatta, Borso del Grappa (IT); Andrea De Luca, Remanzacco (IT); Luca Entesano, Udine (IT); Massimiliano Isera, Trieste (IT); Fabio Flumian, Pramaggiore (IT)

(73) Assignee: DANIELI & C. OFFICINE MECCANICHE SPA, Buttrio (IT)

( * ) Notice: Subject to any disclaimer, the term of this patent is extended or adjusted under 35 U.S.C. 154(b) by 0 days.

(21) Appl. No.: 16/998,547

(22) Filed: Aug. 20, 2020

(65) Prior Publication Data

US 2021/0031260 A1 Feb. 4, 2021

Related U.S. Application Data

(62) Division of application No. 16/333,781, filed as application No. PCT/IT2018/050107 on Jun. 15, 2018, now Pat. No. 10,758,972.

(30) Foreign Application Priority Data

Jun. 16, 2017 (IT) ..... 102017000067508

(51) Int. Cl.

| | |
|---|---|
| ***B22D 11/12*** | (2006.01) |
| ***B22D 11/18*** | (2006.01) |
| ***B22D 11/14*** | (2006.01) |
| ***B22D 11/04*** | (2006.01) |
| ***B22D 11/00*** | (2006.01) |
| ***B22D 11/128*** | (2006.01) |

(52) U.S. Cl.

CPC ..... *B22D 11/18* (2013.01); *B22D 11/009* (2013.01); *B22D 11/0406* (2013.01); *B22D 11/1282* (2013.01); *B22D 11/142* (2013.01)

(58) Field of Classification Search

CPC ..... B22D 11/009; B22D 11/0406; B22D 11/1282; B22D 11/142; B22D 11/18

See application file for complete search history.

(56) References Cited

U.S. PATENT DOCUMENTS

| | | | | |
|---|---|---|---|---|
| 3,924,673 A | | 12/1975 | Vertesi | |
| 4,002,317 A | * | 1/1977 | Fischer | B22D 11/041 249/79 |
| 4,122,888 A | | 10/1978 | Puhringer | |
| 4,273,180 A | * | 6/1981 | Tertishnikov | B22D 11/015 164/467 |

(Continued)

FOREIGN PATENT DOCUMENTS

| | | |
|---|---|---|
| EP | 2441540 A1 | 4/2012 |
| GB | 2105229 A | 3/1983 |

OTHER PUBLICATIONS

Int'l Search Report and Written Opinion dated Sep. 19, 2018 in Int'l Application No. PCT/IT2018/050107.

*Primary Examiner* — Kevin E Yoon

(74) *Attorney, Agent, or Firm* — Panitch Schwarze Belisario & Nadel LLP

(57) ABSTRACT

Method for the continuous casting of a product (P), chosen from billets or blooms, along a curved casting line (18), the method providing to cast a liquid metal (M) in a crystallizer (11) having a tubular cavity (12) with an octagonal cross section.

5 Claims, 2 Drawing Sheets

(56) References Cited

U.S. PATENT DOCUMENTS

| | | | | |
|---|---|---|---|---|
| 4,390,057 | A * | 6/1983 | Reuter | B22D 11/043 164/459 |
| 5,787,966 | A | 8/1998 | Lestani et al. | |
| 6,308,769 | B1 | 10/2001 | Pleschiutschnigg et al. | |
| 6,340,048 | B1 * | 1/2002 | Tsune | B22D 11/041 164/418 |
| 9,296,027 | B2 | 3/2016 | Eckerstorfer et al. | |
| 2004/0020632 | A1 | 2/2004 | Zajber et al. | |

* cited by examiner

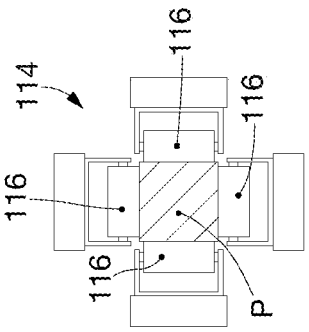
fig. 2
(STATE OF THE ART)
fig. 1
(STATE OF THE ART)
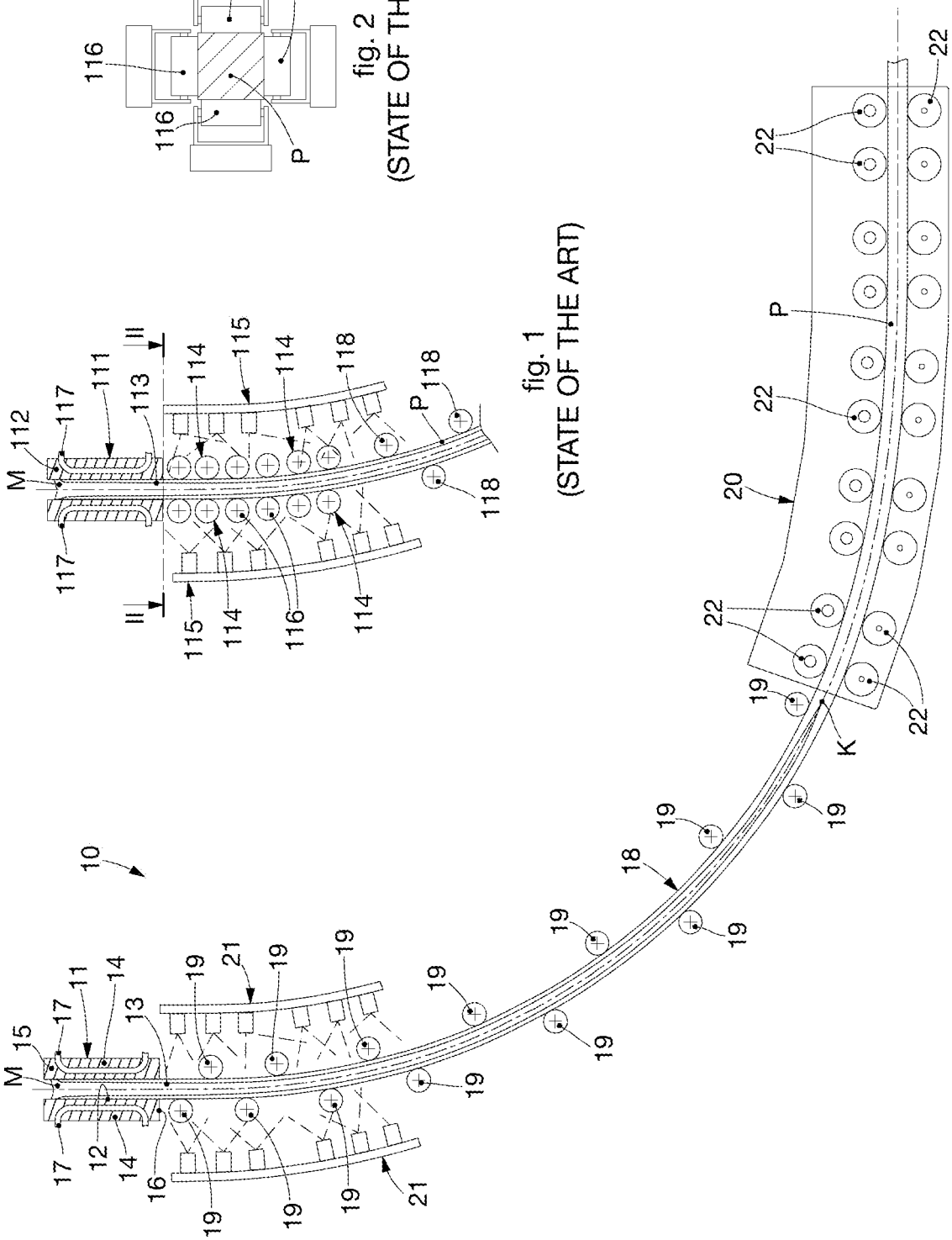
fig. 3

CONTINUOUS CASTING METHOD AND CORRESPONDING APPARATUS

CROSS-REFERENCE TO RELATED APPLICATIONS

This application is a Divisional of co-pending U.S. patent application Ser. No. 16/333,781, filed Mar. 15, 2019, which is a Section 371 of International Application No. PCT/IT2018/050107, filed Jun. 15, 2018, which was published in the English language on Dec. 20, 2018, under International Publication No. WO 2018/229808 A1, which claims priority under 35 U.S.C. § 119(b) to Italian Patent Application No. 102017000067508, filed on Jun. 16, 2017, the disclosures of which are incorporated herein by reference in their entireties.

FIELD OF THE INVENTION

The present invention concerns a continuous casting method and a corresponding apparatus. In particular, the present invention is applied to apparatuses and methods for the curved continuous casting of metal products.

The present invention is also applied to a method and an apparatus for casting billets or blooms having a polygonal shape, for example square, hexagonal or octagonal, although a different number of sides is not excluded, for example pentagonal, heptagonal, etc.

BACKGROUND OF THE INVENTION

It is known that in the field of continuous casting it is provided to discharge molten metal into a mold, also called crystallizer, to at least partly solidify the liquid metal and confer on it a predefined shape. Examples of continuous casting apparatuses having a curved casting line are described in documents GB-A-2.105.229, US-A-2014/090792, DE-A-10.2006.005635, EP-A-2.441.540, and US-A-2004/020632.

With reference to FIGS. 1 and 2, a casting apparatus according to the state of the art is shown, in which the crystallizer 111, for casting billets or blooms, is defined by a tubular body 112, in which the liquid metal M cools. It is also known to provide that the tubular body 112 is provided, in the thickness of its walls, and for at least part of the longitudinal development, with a plurality of cooling channels 117 through which a cooling liquid flows, which indirectly subtracts heat from the liquid product by means of the heat exchange that occurs between it and the walls in contact with the coolant.

The cooling inside the crystallizer is called primary cooling.

By means of the heat exchange, the product P starts to solidify externally, determining the formation of a surface skin 113 that becomes thicker as the product P approaches the exit from the crystallizer 111. The formation of the thickness of the skin 113 is influenced by the casting speed and therefore by productivity. The casting speed determines the permanence of the skin 113 in the crystallizer 111.

Normally, in this type of continuous casting apparatus, it is necessary to support the product P at exit from the crystallizer 111, due to the problems described below.

The external surfaces of the metal product are normally supported, along the casting line, by special roller guide systems, or mobile containing sectors 114, substantially parallel to the faces of the product P which they have to support.

Each containing sector 114, as shown in FIG. 2, is normally provided with a plurality of rollers 116 located so as to laterally surround the lateral section of the product P which is cast, so as to define the containment of the latter.

At the same time, the thickness of the skin 113 in formation must also be increased by means of a direct cooling of the product P, called secondary cooling.

The secondary cooling can take place either by means of said mobile sectors 114, provided with an internal cooling system, or by means of sprays 115, using normal or nebulized water, accompanying the product P until the inside is completely solidified in the so-called kissing point K, that is, the point along the casting line where the cross section of the cast product P is completely solidified.

The containing sectors 114 therefore constitute the external skeleton which allows the product P to descend along the casting line, to cool down and to pass from a vertical position to a horizontal position, following the theoretical casting radius of curvature.

The containing sectors 114, moreover, accompany the cast product P toward the straightening units which draw the cast product P out of the casting apparatus.

Along the casting line, in a zone comprised between the containing sectors 114 and the straightening units, there are normally support and bending rollers 118 provided to support and curve the metallic product P from the vertical condition to the horizontal condition. The support and bending rollers 118 are located distanced along the casting line and alternately one on the intrados side and the next on the extrados side of the casting line.

As we said, the mobile containing sectors 114 are necessary not only to cool the product P, but also to support the faces defining the product itself in fact, the skins forming the product P are characterized by having a rather low thickness, and are subject to the phenomenon of "bulging", that is, a swelling effect caused by the ferrostatic pressure which thrusts toward the outside the fraction of liquid product, swelling the walls of solidified skin.

Normally this phenomenon is contained by the containing sectors 114, which limit the entity thereof to negligible bulging, and which therefore do not compromise the castability of the product P.

In fact, if these swellings were free to manifest themselves, the skin 113 in formation of the product P would be subject to breakages. These breakages can be localized on the surface, causing a reduction in the quality of the product P cast, or they can determine a complete rupture of the skin with the consequent leakage of liquid metal (break out). In addition to constituting a danger, this determines very high maintenance and considerable economic losses.

However, even with the use of the mobile containing sectors 114 the casting process is not risk free.

In fact, it is essential to have a perfect alignment of the mobile containing sectors 114 with respect to the product P, both downstream of the crystallizer 111 and also along the rest of the casting line, until it engages with the straightening units downstream.

The alignment of the containing sectors 114, in fact, has to follow the natural shrinkage of the skin of the product P, which takes place as a consequence of cooling. If, for some reason, the contact between the skin and the containing sectors 114 were to occur in an inappropriate way, there are concrete possibilities that the skin can be pinched or torn, thus causing potential break-outs.

In any case, the maintenance made necessary by the containing sectors 114 is quite high, given that each face of the product P is supported by a containing sector 114 for almost the entire casting curve. Furthermore, the alignment must be done manually by operators outside the casting line, so great expertise is required during assembly in the work place, given that the containing sectors 114 often become misaligned during this step.

There is therefore a need to perfect a casting method which overcomes at least one of the disadvantages of the state of the art.

One purpose of the present invention is to perfect a continuous casting method which is efficient and allows to achieve high productivity.

It is also a purpose of the present invention to perfect a continuous casting method which allows to limit maintenance interventions on parts of the casting apparatus.

Another purpose of the present invention is to perfect a continuous casting method which allows to increase the quality of the cast products.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, the present invention concerns a method for the continuous casting of a product, chosen from billets or blooms, along a curved casting line.

The method provides to cast a liquid metal in a crystallizer that is provided with a tubular cavity having a polygonal cross section defined by a determinate number of sides, in particular eight sides.

In accordance with one aspect of the present invention, the product exiting from the crystallizer is curved along the casting line by support and curving rollers and without the aid of containing sectors of the cross section of the product downstream of the crystallizer.

Moreover, the method comprises setting a productivity of the casting line, and therefore a casting speed, chosen inside a predefined work field and as a function of the number of sides, and supplying the crystallizer having a number of sides determined so as to obtain the set productivity, and so that the product, at exit from the crystallizer, has at least a minimum thickness of solidified skin and so that the deformation of the skin is limited below a threshold value.

More specifically, it is provided to cast the product with a productivity comprised between 60 t/h and 260 t/h.

In particular, said work field is defined by a first achievable maximum productivity, and by a second achievable maximum productivity, wherein the first achievable maximum productivity is defined by the expression:

$$P_{rmaxb} = 0,9 * \rho * K^2 * \left(\frac{n}{\tan\left(\frac{\pi}{n}\right)}\right)$$

wherein:

ρ: is the density of the solid metal,

K: is a constant comprised between 0.04 and 0.05; and n: is the number of sides of said polygon of the tubular cavity (12);

and said second achievable maximum productivity ($P_{rmaxt}$) is defined by the expression:

$$P_{rmaxt} = 0,9 * \rho * D^2 * \left(\frac{K_s}{t_{min}}\right)^2 * n * \tan\left(\frac{\pi}{n}\right)$$

wherein

ρ: is the density of the solid metal;

D: is a size of the cross section of said product (P);

$K_S$: is a solidification constant determined as a function of the material of said liquid metal (M);

$t_{min}$: is a preset minimum thickness of said product (P);

n: is the number of sides of the polygon of the tubular cavity (12).

Moreover, the productivity is set so that it is less than or equal to the minimum value between the first maximum productivity and the second maximum productivity.

The method according to the invention therefore allows to increase the productivity of a casting line limiting the management costs compared to known solutions, avoiding having to use containing sectors downstream of the crystallizer and therefore limiting the problems of maintenance and control connected thereto.

This is made possible thanks to the fact that, on the basis of the settings cited above, the product at exit from the crystallizer has at least a minimum thickness of solidified skin and the deformation of the skin is limited below a threshold value, or is not subjected to phenomena of bulging.

To overcome the problem of bulging, due to the ferrostatic pressure of the liquid on the walls of the product, it is necessary that the latter are able to self-support, limiting the effect of swelling.

This property is directly connected to the productivity of the continuous casting apparatus, in fact:

to allow the production of products with large sections, it is necessary to advance at reduced speeds, so as to give the forming skin the time to thicken sufficiently; however, this limits productivity;

vice versa, for products with small sections it is possible to increase the casting speed, given that the sides, being narrower and offering less surface, have less chance of developing bulges; however, even by casting small sections rapidly, productivity is limited.

The present invention, therefore, makes it possible to identify the maximum productivity (casting speed) of an apparatus for continuous casting so that the product, at exit from the crystallizer, has a "bulging" value below a predetermined limit value and a skin thickness value higher than another predetermined limit value.

Furthermore, by increasing the productivity of the apparatus it is also possible to reduce the casting lines necessary to produce a determinate quantity of product.

In particular, although not exclusively, a casting layout, regulated according to the method of the present invention, is optimal for "micromill" plants, in which there is a single casting line which feeds a rolling mill directly in endless mode.

In fact, it is known that it is necessary to feed a micromill plant with high productivities in order to effectively feed the rolling train that follows the casting line.

Embodiments of the present invention also concern a continuous casting apparatus comprising a curved casting line provided with a crystallizer having a tubular cavity with a polygonal cross section defined by a determinate number of sides, in particular eight sides. According to one aspect of the invention, rollers to support and curve the product are installed along said casting line and there are no sectors for the containment of the cross section of the product.

BRIEF DESCRIPTION OF THE DRAWINGS

These and other characteristics of the present invention will become apparent from the following description of some embodiments, given as a non-restrictive example with reference to the attached drawings wherein:

FIG. 1 is a schematic view of a continuous casting apparatus in accordance with the known state of the art;

FIG. 2 is a section view along the section line II-II of FIG. 1;

FIG. 3 is a schematic illustration of an apparatus for the continuous casting of metal products in accordance with the present invention;

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

Figure 4:
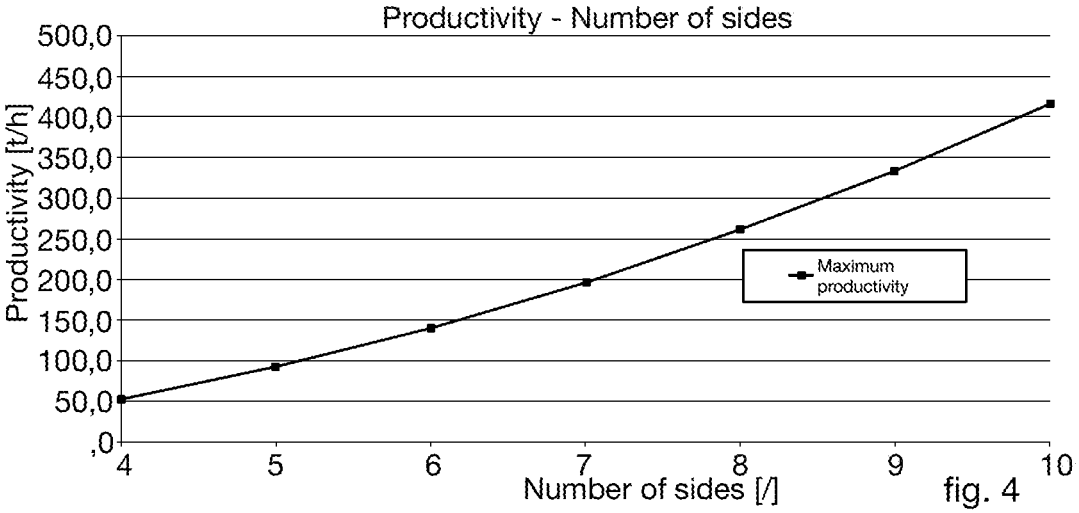
FIG. 4 is a graph that shows the variation of the maximum productivity in relation to the number of sides of a cast product and estimated in relation to phenomena of bulging.

Embodiments of the present invention concern a method for the continuous casting of a product P along a curved casting line 18.

By curved casting line 18 we intend to comprise both an apparatus that develops along a completely curved casting line, and also a vertical casting line in the initial segment and subsequently curved.

With reference to FIG. 3, an apparatus for continuous casting, according to the present invention, is indicated in its entirety by the reference number 10 and is suitable to cast a metal product P selected in a group comprising billets and blooms.

The apparatus 10 comprises a crystallizer 11 having a tubular shape and provided with a tubular cavity 12 in which liquid metal M is discharged during use.

The crystallizer 11 allows to solidify the liquid metal M, generating a solidified external skin 13.

The skin 13 has a thickness "t" which progressively increases from the solidification zone, inside the crystallizer 11, until reaching a point, called "kissing point K", usually outside the crystallizer 11, in which the product P is completely solidified.

According to possible embodiments, the tubular cavity 12 has a polygonal cross section shape determined by a determinate number of sides "n", in particular eight sides. By way of example only, in embodiments not comprised within the invention, the cross section of the tubular cavity 12 has a square, hexagonal, or decagonal shape.

Embodiments of the present invention can provide that the tubular cavity 12 is defined by a plurality of walls 14 defining the sides of the crystallizer 11.

In some embodiments of the present invention, the walls 14 of the crystallizer 11 all have the same sizes. In this way the skin 13 that is formed during casting has a conformation substantially mating with that of the casting cavity 12, and the sides of the skin 13, having the same sizes, will be subjected to the same stresses, for example to the same ferrostatic pressure.

However, it is not excluded that in possible variant embodiments the walls 14 have different sizes or width.

The crystallizer 11 is provided with a first end 15 through which the liquid metal M is fed, and a second end 16, opposite the first end 15, through which the partly solidified product P is discharged from the crystallizer 11.

The crystallizer 11 is provided with cooling means 17 configured to cool the crystallizer 11 which, in turn, exerts a cooling action on the liquid metal M and allows the formation of the skin 13.

Downstream of the crystallizer 11 there are support and curving rollers 19 configured to support and curve the product P along the casting line 18.

In particular, it is provided that the support and curving rollers 19 are installed reciprocally distanced along the casting line and are located in succession one on the intrados side and the other on the extrados side of the casting line 18 itself.

The support and curving rollers 19 can be disposed only on the extrados and intrados side of the casting line 18.

In accordance with possible solutions, it can be provided that the support and curving rollers 19 are installed directly downstream of the exit from the crystallizer 11.

According to the present invention, the product P exiting from the crystallizer 11 is therefore directly accompanied and curved along the casting line by the support and curving rollers 19 and without the aid of containing sectors of the cross section of the product P.

By containing sectors of the cross section, we mean containing elements which are located facing each other to peripherally surround the sides of the cross section of the cast product P.

In accordance with other solutions, downstream of the support and curving rollers 19, the casting apparatus 10 comprises straightening and/or drawing units 20 configured to straighten the product P and/or possibly carry out an action to compress it.

The straightening and/or drawing unit 20 determines a casting speed $V_c$ of the product itself along the casting line 18.

For this purpose, the straightening and/or drawing unit 20 can be provided with rollers 22 having the function of straightening, compression, and/or drawing.

According to a possible embodiment of the present invention, the product P exiting from the crystallizer 11 is supported and guided, or curved, only by the action of the support and curving rollers 19, until it enters the straightening and/or drawing unit 20.

According to possible solutions, the support and curving rollers 19 can be provided with cooling devices, such as internal cooling channels, to cool both the support and curving rollers 19 themselves, and the skin 13 of the product P.

In accordance with other embodiments of the present invention, the apparatus 10 can also comprise cooling means 21, for example nozzles, to deliver nebulized water, so as to further cool the product P.

The method according to the present invention provides to cast the liquid metal M into the crystallizer 11.

The product P exiting from the crystallizer 11 is curved along the casting line by means of the support and curving rollers 19 and without the aid of containing sectors of the cross section of the product P.

According to one aspect of the present invention, before starting the casting, the method comprises setting a productivity $P_r$ of the casting line 18 which is selected inside a predefined work field and a function of the number of sides n of the tubular cavity 12, or of the crystallizer 11.

Furthermore, the method provides to supply the crystallizer 11 having a number of sides n, in particular eight sides, determined so as to obtain, or achieve, said preset productivity $P_r$ and so that the product P, at exit from the crystallizer 11, has at least a minimum thickness $t_{min}$ of solidified skin 13 and so that the deformation of the skin 13 is limited below a threshold value.

The choice of the crystallizer 11, according to the present invention, allows to prevent the occurrence of deformations of the skin 13 such as to cause any damage thereto. In particular, the deformations of the skin 13 must be such as not to exceed at least the breaking or yield point of the skin 13 itself.

During casting, the skin 13 of the product P is in fact subjected to a phenomenon of deformation, or bulging.

The phenomenon of bulging is caused by the ferrostatic pressure which the liquid metal M exerts on the skin 13 of the product P and which causes a maximum deformation or deflection of the skin 13.

Furthermore, during casting, it is necessary to guarantee that the product P exiting from the crystallizer 11 has a minimum thickness of its skin 13 such as to support said phenomena of bulging.

In accordance with possible embodiments, and as described also hereafter, the work field is delimited by a first achievable maximum productivity $P_{rmaxb}$ determined in such a way as to prevent the skin 13 from deforming above said threshold, or from being subject to the phenomenon of bulging, and a second maximum productivity achievable $P_{rmaxt}$ determined so that the skin 13 has at least the minimum thickness $t_{min}$.

In order to prevent the occurrence of the problem of bulging, Applicant has experimentally identified a correlation between the sizes of the side of the product P and the maximum casting speed that can be expressed by the relation:

$$V_{cmaxb}=(K/W)\hat{}2$$

wherein:

W is the size of the side [m];

$V_{cmaxb}$ is the maximum casting speed [m/min] above which a phenomenon of bulging occurs, at a level unsustainable by the wall of the product P;

K is a constant comprised between 0.04 and 0.05 $(m^3/s)^{0.5}$, preferably between 0.042 and 0.047 $(m^3/s)^{0.5}$.

The casting speed at regime $V_c$ respects the following inequality:

$$V_c \leq (K/W)\hat{}2$$

Thanks to this formula it is possible to determine the optimal size of the side of each product for determinate maximums of achievable casting speed, avoiding the use of containment and at the same time avoiding the risk of unsustainable bulging.

At this point, knowing the maximum casting speed at which to produce and the optimal sizes of the sides in order to contain bulging, it is possible to calculate the production limits for products of different polygonal shapes.

From literature, the productivity of a casting line is defined as the mass flow rate passing through the crystallizer, which can be calculated as:

$$P_r=3.6*\rho*A*V_c$$

wherein:

$P_r$ is hourly productivity [t/h]

ρ is the density of the solid metal, for example solid steel, which includes the solidification effect [kg/m3]

A is the product section P $[m^2]$ $V_c$ is the casting speed [m/min]

Similarly, using the maximum casting speed $V_{cmaxb}$ instead of the casting speed $V_c$, the achievable maximum productivity $P_{rmaxb}$ is determined with profiles of every polygonal shape, beyond which unsustainable problems of bulging arise.

$$P_{rmaxb}=3.6*\rho*A*V_{cmaxb}$$

In turn, the section of the product P can be calculated as:

$$A=W^2*f$$

wherein:

W is the size of the side [m]

f is the fixed area number.

The fixed area number represents the ratio between the area of the polygon and the area of a square which has for its side the side of the polygon.

Each regular polygon has its own fixed area number, summarized below:

| Regular polygon | f |
|---|---|
| Triangle | 0.433 |
| Square | 1 |
| Pentagon | 1.720 |
| Hexagon | 2.598 |
| Heptagon | 3.634 |
| Octagon | 4.828 |
| Nonagon | 6.182 |
| Decagon | 7.694 |

The fixed area number can however be calculated trigonometrically as:

$$f - \frac{n}{4*\tan\left(\frac{\pi}{n}\right)}$$

wherein:

n is the number of sides of the polygon.

At this point it is possible to replace, in the formula of the maximum hourly productivity $P_{rmaxb}$ seen previously, the terms of the maximum casting speed $V_{cmaxb}$ and of the area A of the product P, again according to the previous formulas and taking into account the previously selected factor K $$P_{rmaxb} = 0,9*\rho*K^2*\left(\frac{n}{\tan\left(\frac{\pi}{n}\right)}\right)$$

Thanks to the latter formula it is therefore possible to establish, for every possible profile of the product P, which maximum productivity can be achieved without having to resort to the containing sectors downstream of the crystallizer.

In order to avoid problems with deformation of the skin 13, the productivity $P_r$ of the casting line 18 must be less than or, at most, equal to the $P_{rmaxb}$ defined above, that is, $P_r \leq P_{rmaxb}$ must be obtained.

FIG. 4 shows the maximum productivity $P_{rmaxb}$ associated with products P having from a minimum of 4 sides to a maximum of 10, using the following data by way of example:

| Description | Symbol | Value | Unit |
|---|---|---|---|
| Density of product P | ρ | 7750 | $kg/m^3$ |
| Maximum constant bulging | K | 0.044 | $(m^3/s)^{0.5}$ |

Applying the above formula we obtain the following productivities $P_{rmaxb}$:

| Number of sides of product P | Maximum bulging limit |
|---|---|
| 4 | 54.0 |
| 5 | 92.9 |
| 6 | 140.3 |
| 7 | 196.3 |
| 8 | 260.8 |
| 9 | 333.9 |
| 10 | 415.6 |

From the analysis of FIG. 4 it is possible to notice that the area subtended by the curve of maximum productivity represents every possible production capacity, for each type of product P, which does not require containing downstream of the crystallizer.

For example, a productivity $P_r$ of 140 t/h can be achieved, regardless of the size of the side W, with a crystallizer 11 of hexagonal shape at full power, or with an octagonal shape at medium power.

In embodiments not comprised within the invention, the shape of the polygon of the casting cavity 12 is selected from square and hexagon, that is, a polygon having a number of sides equal to four, or six.

According to the present invention, the shape of the polygon of the casting cavity 12 is selected octagonal, that is, a polygon having eight sides.

There is also another physical limit to productivity regarding the minimum thickness $t_{min}$ of the skin 13 exiting from the crystallizer 11 in order to guarantee that the product P is self-supporting.

The skin 13, in fact, since it is not supported by the containing sectors, must have a thickness sufficient to allow the product P to exit integral from the crystallizer 11, to proceed along the casting line 18 and to cool, without ever yielding to unsustainable phenomena of bulging or breaking.

The thickness t of the skin 13 of the product P exiting from the crystallizer 11 is directly linked to the casting speed $V_c$; in fact, through the solidification constant $K_S$ of the product P, a higher casting speed $V_c$ determines a lesser thickness of the skin 13 of the product P and vice versa.

The thickness t of the skin 13 of the product P exiting from the crystallizer 11 must therefore be greater than or equal to a minimum safety thickness $t_{min}$.

In the state of the art, the minimum safety thickness $t_{min}$ can generally be between 6 mm and 10 mm, and the present invention suggests preferably between 7 mm and 9 mm, even more preferably about 8 mm.

The limit to productivity $P_r$ due to the minimum thickness $t_{min}$ at exit from the crystallizer 11 is obtained starting from the equation known from literature for a thickness equal to $t_{min}$:

$$t \geq t_{min} = \frac{K_s}{\sqrt{V_{cmaxt}}} \rightarrow V_{cmaxt} = \left(\frac{K_s}{t_{min}}\right)^2$$

As can be seen, the limit in terms of minimum thickness $t_{min}$ entails the need not to exceed a determinate value of casting speed $V_{cmaxt}$.

This limitation to the casting speed $V_{cmaxt}$ consequently implies a constraint on the maximum productivity $P_{rmaxt}$ achievable:

$$P_r \leq P_{rmaxt} = 3,6 * \rho * A * V_{cmaxt} = 3,6 * \rho * W^2 * f * \left(\frac{K_c}{t_{min}}\right)^2$$

The side of the polygon W can be expressed as a function of the diameter D of the circumference inscribed in the polygon which describes the section of the product P, since for the purposes of cooling the edges are less problematic, as they cool more quickly.

In particular it is known that:

$$W = D * \tan(\pi/n)$$

therefore the maximum productivity, in t/h, achieved with the limit in terms of minimum thickness, becomes:

$$P_{rmaxt} = 0,9 * \rho * D^2 * \left(\frac{K_s}{t_{min}}\right)^2 * n * \tan\left(\frac{\pi}{n}\right)$$

Unlike what is obtained with regard to bulging, the maximum productivity with the limit in terms of minimum thickness, besides being a function of the number of sides n, also depends on $t_{min}$ and D.

The productivity $P_r$ of the casting line, estimated taking into consideration a limit thickness of the skin, must therefore be less than or equal to the $P_{rmaxt}$ calculated above, or $P_r \leq P_{rmaxt}$.

Figure 5:
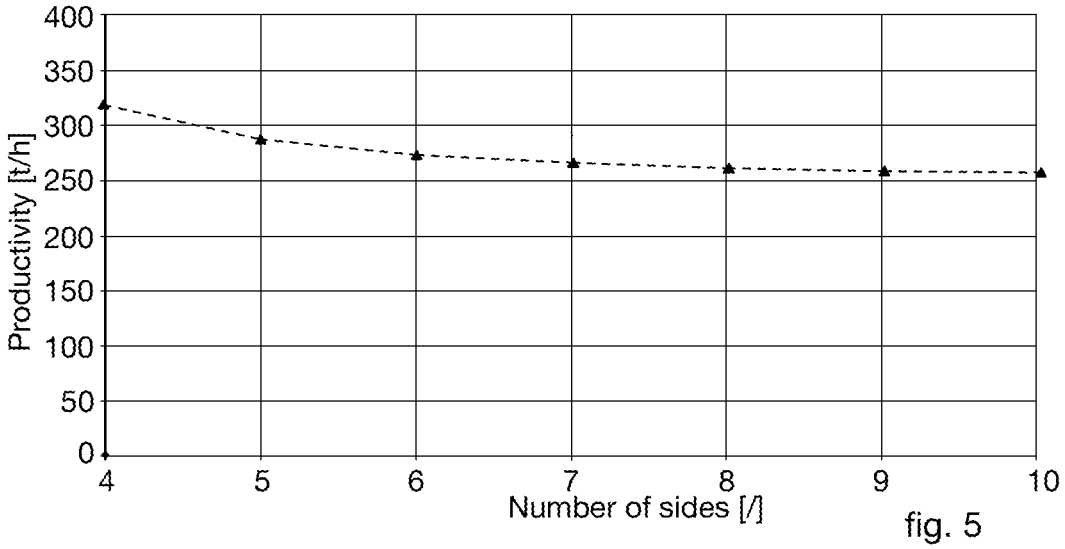
FIG. 5 is a graph that shows the variation of the maximum productivity in relation to the number of sides of a cast product and estimated so as to guarantee a thickness of the solid skin of the cast product at exit from the crystallizer.

FIG. 5 represents the maximum productivity $P_{rmaxt}$ associated with products P having from a minimum of 4 sides to a maximum of 10, using the following data by way of example:

| Description | Symbol | Value | Unit |
|---|---|---|---|
| Density of product P | ρ | 7750 | $kg/m^3$ |
| Solidification constant | $K_S$ | 3.87E−03 | $m/s^{0.5}$ |
| Inscribed diameter | D | 0.22 | m |
| Minimum thickness | $t_{min}$ | 0.008 | m |

Using these data in the above formula, we obtain the following productivity limits $P_{rmaxt}$ for different types of products P:

| Number of sides of product P | thickness = 8 mm Productivity |
|---|---|
| 4 | 316.49 |
| 5 | 287.43 |
| 6 | 274.09 |
| 7 | 266.72 |
| 8 | 262.19 |
| 9 | 259.18 |
| 10 | 257.09 |

In particular, the curve which describes the maximum productivity $P_{rmaxt}$ has an asymptotic development, being essentially a function of the expression n*tan(π/n) which for n tending to infinity assumes the constant value π. This development means that, beyond a certain n, the maximum productivity $P_{rmaxt}$ achievable remains constant, so that a further increase in the number of sides n does not lead to any advantage.

According to one aspect of the present invention, the casting line 18 can have a productivity $P_r$ greater than or equal to 60 t/h.

From the graph in FIG. 5 it is thus clear that the achievable maximum productivity for a cast product P having D equal to 220 mm and $t_{min}$ of 8 mm is about 260 t/h, with n equal to eight (octagon), while with a square crystallizer (not comprised within the invention), because of maximum bulging, it is not possible to exceed 54 t/h. In addition, beyond a number of sides equal to ten (not comprised within the invention), the maximum productivity settles at a value of 257 t/h. Therefore, in order to achieve a maximum productivity close to 260 t/h, it is best to adopt a crystallizer with 8 sides, since the use of a crystallizer with 9 sides (not comprised within the invention) would entail problems in moving and supporting the product P, while using a crystallizer with 10 or more sides (not comprised within the invention) would not have any advantage in terms of productivity.

From the formula and the tables discussed above it is also clear that in order to achieve a maximum productivity of 260 t/h with an octagonal crystallizer, ensuring a minimum skin thickness of the cast product comprised between 7 min and 9 mm, the crystallizer can be provided with a tubular cavity 12 with a diameter D of the circumference inscribed in the octagonal cross section comprised between 192 mm and 246 mm.

Figure 6:
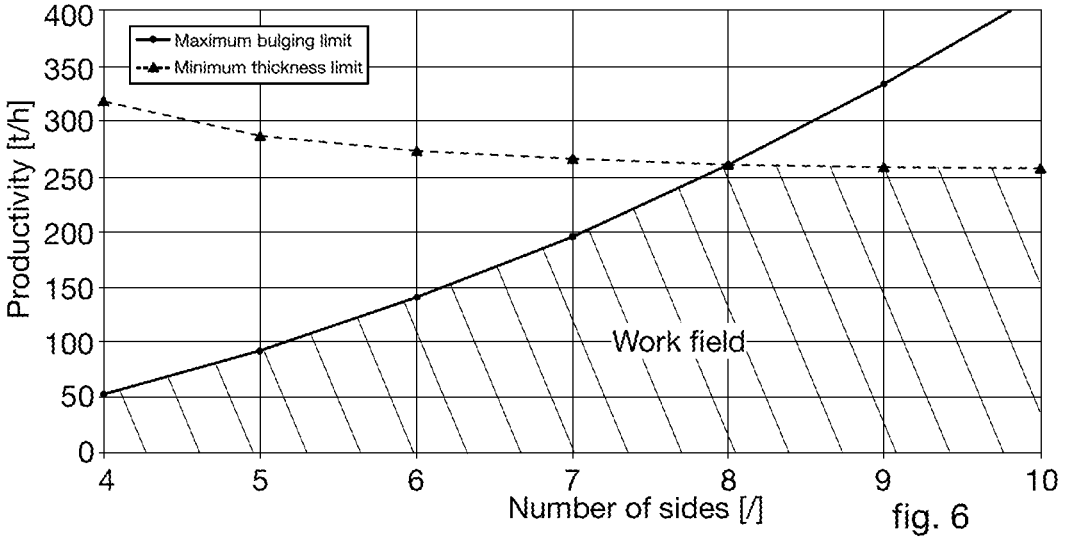
FIG. 6 is a graph that combines the graphs of FIGS. 4 and 5 and identifies the work field for the choice of the productivity of said casting apparatus.

From the union of the curves shown in FIGS. 4 and 5 which show the limited productivities, respectively one based on the maximum tolerable bulging ($P_{rmaxb}$), and the other with respect to the minimum skin thickness necessary to support the product P at exit from the crystallizer ($P_{rmaxt}$), the graph shown in FIG. 6 is obtained, which shows the optimal work field, in which the designer can choose the type of product P and the desired productivity, represented by the area subtended by the two curves.

From the analysis of the graph in FIG. 6 it is therefore seen that for profiles from square to octagonal, productivity is limited mainly by the containing of the bulging, whereas from octagonal onward the limit is set by the minimum thickness of skin which must be guaranteed to the product exiting from the crystallizer.

The designer who wants to obtain very high productivity without the aid of containment will have to opt for casting at least octagonal sections, while for more modest productivity he will be able to choose from a greater range of castable sections.

In particular, the method provides that the productivity $P_r$ set in the casting line, for the specific number of sides n of the crystallizer 11 selected, is lower than or equal to the minimum value between the first maximum productivity ($P_{rmaxb}$) and the second maximum productivity ($P_{rmaxt}$).

Furthermore, by combining the productivities expressed above $P_{rmaxb}$ and $P_{rmaxt}$ it is possible to identify an optimal number of sides which allows to optimize the casting productivity.

In particular, if $P_{rmaxb}=P_{rmaxt}$ we obtain $$0,9*\rho*K^2*\left(\frac{n}{\tan\left(\frac{\pi}{n}\right)}\right)=0,9*\rho*D^2*\left(\frac{K_s}{t_{min}}\right)^2*n*\tan\left(\frac{\pi}{n}\right)$$

$$\frac{K^2}{\tan\left(\frac{\pi}{n}\right)}-D^2*\left(\frac{K_s}{t_{min}}\right)^2*\tan\left(\frac{\pi}{n}\right)$$

$$\left(\frac{K}{K_s}*\frac{t_{min}}{D}\right)=\tan\left(\frac{\pi}{n}\right)$$

and finally $$n=\left(\frac{\pi}{\arctan\left(\frac{K}{K_s}*\frac{t_{min}}{D}\right)}\right)$$

from which it derives that the reference number is equal to the integer number, approximated by default, of the expression in brackets. That is:

$$n_{ott}-\text{int}\left(\frac{\pi}{\arctan\left(\frac{K}{K_s}*\frac{t_{min}}{D}\right)}\right)$$

From this expression of the optimal number of sides it is also possible, based on the expressions above, to identify the limits of the casting speed $V_c$ of the casting line 18.

In particular, if the crystallizer 11 has a number of sides n lower than the optimum number of sides $n_{ott}$, it is provided to cast the product P with a casting speed expressed by the relation:

$$V_c \leq (K/W)\hat{}2$$

While if the crystallizer 11 has a number of sides n greater than the number of optimum sides $n_{ott}$, it is provided to cast the product P with a casting speed $V_c$ expressed by the relation:

$$V_c \leq \left(\frac{K_s}{t_{min}}\right)^2$$

It is clear that modifications and/or additions of parts can be made to the continuous casting method and corresponding continuous casting apparatus as described heretofore, without departing from the field and scope of the present invention.

It is also clear that, although the present invention has been described with reference to some specific examples, a person of skill in the art shall certainly be able to achieve many other equivalent forms of continuous casting method and corresponding continuous casting apparatus, having the characteristics as set forth in the claims and hence all coming within the field of protection defined thereby.

In the following claims, the sole purpose of the references in brackets is to facilitate reading: they must not be considered as restrictive factors with regard to the field of protection claimed in the specific claims.

The invention claimed is:

1. Method for the continuous casting of a product (P), chosen from billets or blooms, along a curved casting line (18), to obtain a productivity comprised between 60 t/h and 260 t/h, said method providing to cast a liquid metal (M) in a crystallizer (11) that is provided with a tubular cavity (12) having an octagonal cross section, and to curve said product (P) exiting from said crystallizer (11) along said casting line (18) by means of support and curving rollers (19) and without the aid of containing sectors of the cross section of said product (P), wherein said tubular cavity (12) is sized to cast products with diameter (D) of the circumference inscribed in the octagonal cross section comprised between 192 mm and 246 mm, at a maximum achievable productivity of 260th to grant a minimum safety skin thickness $t_{min}$ between 7 mm and 9 mm.

2. Method as in claim 1, wherein said tubular cavity (12) is defined by a plurality of walls (14) defining the sides of the crystallizer (11), said walls (14) of the crystallizer (11) having all the same size.

3. Method as in claim 2, wherein said cast product (P) exiting from the crystallizer (11) have a safety minimum skin thickness $t_{min}$ of about 7.8 mm to 8.2 mm.

4. Method as in claim 1, wherein said cast product (P) exiting from the crystallizer (11) have a safety minimum skin thickness $t_{min}$ of about 7.8 mm to 8.2 mm.

5. Method as in claim 1, wherein increasing the size of the cross section of said tubular cavity (12) the cast velocity is reduced, and vice versa, keeping the cast productivity in the aforementioned range.

* * * * *